US005279473A

United States Patent [19]

Rozon

[11] Patent Number: 5,279,473

[45] Date of Patent: Jan. 18, 1994

[54] CORD RETRACTION DEVICE

[75] Inventor: David Rozon, Russell, Canada

[73] Assignee: 2844788 Canada Ltée, Hull, Canada

[21] Appl. No.: 877,212

[22] Filed: May 1, 1992

[51] Int. Cl.[5] ..... B65H 75/48

[52] U.S. Cl. ..... 242/107.12; 160/178.1

[58] Field of Search ..... 242/100.1, 107.1, 107.11, 242/107.12, 107.13, 107.14, 107.15; 160/178.1, 320

[56] References Cited

U.S. PATENT DOCUMENTS

| | | | |
|---|---|---|---|
| 898,083 | 9/1908 | Amstalden | 242/107.12 |
| 2,565,339 | 8/1951 | Anderson | 242/100.1 |
| 2,678,779 | 5/1954 | Bellmer | 242/107.1 |
| 2,834,314 | 5/1958 | Moore | 242/107.12 |
| 3,693,596 | 9/1972 | Croce | 242/107.12 |
| 3,716,436 | 2/1988 | Lerner et al. | 242/100.1 |
| 3,809,331 | 5/1974 | Gaul | 242/100.1 |
| 4,271,893 | 6/1981 | McClusky | 160/178 R |
| 4,466,581 | 8/1984 | Hill | 242/100.1 X |
| 4,802,638 | 2/1989 | Burger et al. | 242/100.1 |
| 4,909,298 | 3/1990 | Langhart | 160/178.1 |

FOREIGN PATENT DOCUMENTS

| | | | |
|---|---|---|---|
| 756034 | 8/1956 | United Kingdom | 242/107.12 |

*Primary Examiner*—Daniel P. Stodola
*Assistant Examiner*—Eileen Dunn
*Attorney, Agent, or Firm*—Adrian Zahl

[57] ABSTRACT

A cord retraction device specifically adapted for use with window blinds is provided, having cord attachment member adapted to engage a cord loop to a take up spool, wherein the loop is free to slide through the attachment member when the cord is in the unretracted position.

8 Claims, 5 Drawing Sheets

CORD RETRACTION DEVICE

FIELD OF THE INVENTION

The present invention relates to a cord retraction device for the reversible taking up of slack in cord, cable, chain, string or the like.

BACKGROUND OF THE INVENTION

Retraction devices for the taking up of slack in cord, free-ended chains, cables, string and the like (all of which will be referred to herein as "cord") serve an important safety and convenience function in many fields. The present invention is directed towards a device that has particular application for taking up the cords of window blinds. Such devises may serve an safety important function when used with window blinds, since the long dangling cords of window blinds can pose a hazard to young children. A retraction device for use with window blind cords is preferably adaptable for use with, alternatively, a pair of free-ended cords, as is found in a venetian blind, or a cord loop, as is found in a vertical blind. For use with a cord loop, the retraction device must be capable of allowing the cord to pass freely through the device when in the unretracted position. As well, it is desirable to provide a retraction device that can be readily engaged to a cord, in order for easy attachment to a installed window blind.

While many retraction devices exist for the taking up of cord, these existing devices do not provide an adequate solution to the requirements of window blind cord retraction devices.

Retraction devices typically comprise two elements: a rotatable take-up spool and a spool support. The take-up spool is generally spring loaded, although it may also be rotated by a crank. The spring is typically a coil spring positioned inside the spool, one end thereof being fastened to the perimeter of the spool and the other end being fastened to a central spindle engaged to the spool support. The spool support is generally incorporated into a case, with the cord entering the case through an aperture extending through the wall of the case. There may also be provided spool lock means, to releasably lock the spool in either the wound or unwound position, or any intermediary position.

SUMMARY OF THE INVENTION

The present invention is a cord retraction device comprising a spool having a cord-receiving surface, drive means to rotate the spool, cord guide means to direct cord towards the cord-receiving surface of the spool to be wound up thereon. The spool is provided with cord loop attachment means adapted to slidingly engage a cord loop, wherein the loop is free to slide through the attachment means when the cord is in an unwound position.

In a preferred embodiment of the invention, the attachment means comprises a member removably engaged to the cord-receiving surface of the spool, the member having a passage extending therethrough, adapted to slidingly engage a cord loop within the passage or alternatively to fixedly engage the free ends of one or more free-ended cords.

DETAILED DESCRIPTION OF THE PREFERRED EMBODIMENT

Figure 1:
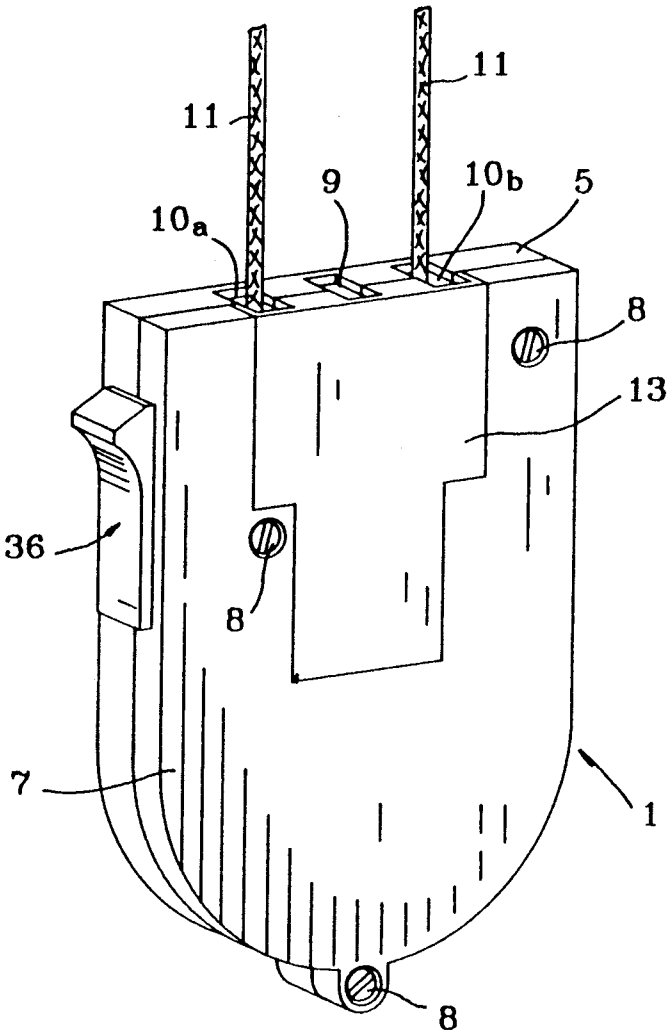
FIG. 1 is a perspective view of a cord retraction device according to the present invention.
Figure 2:
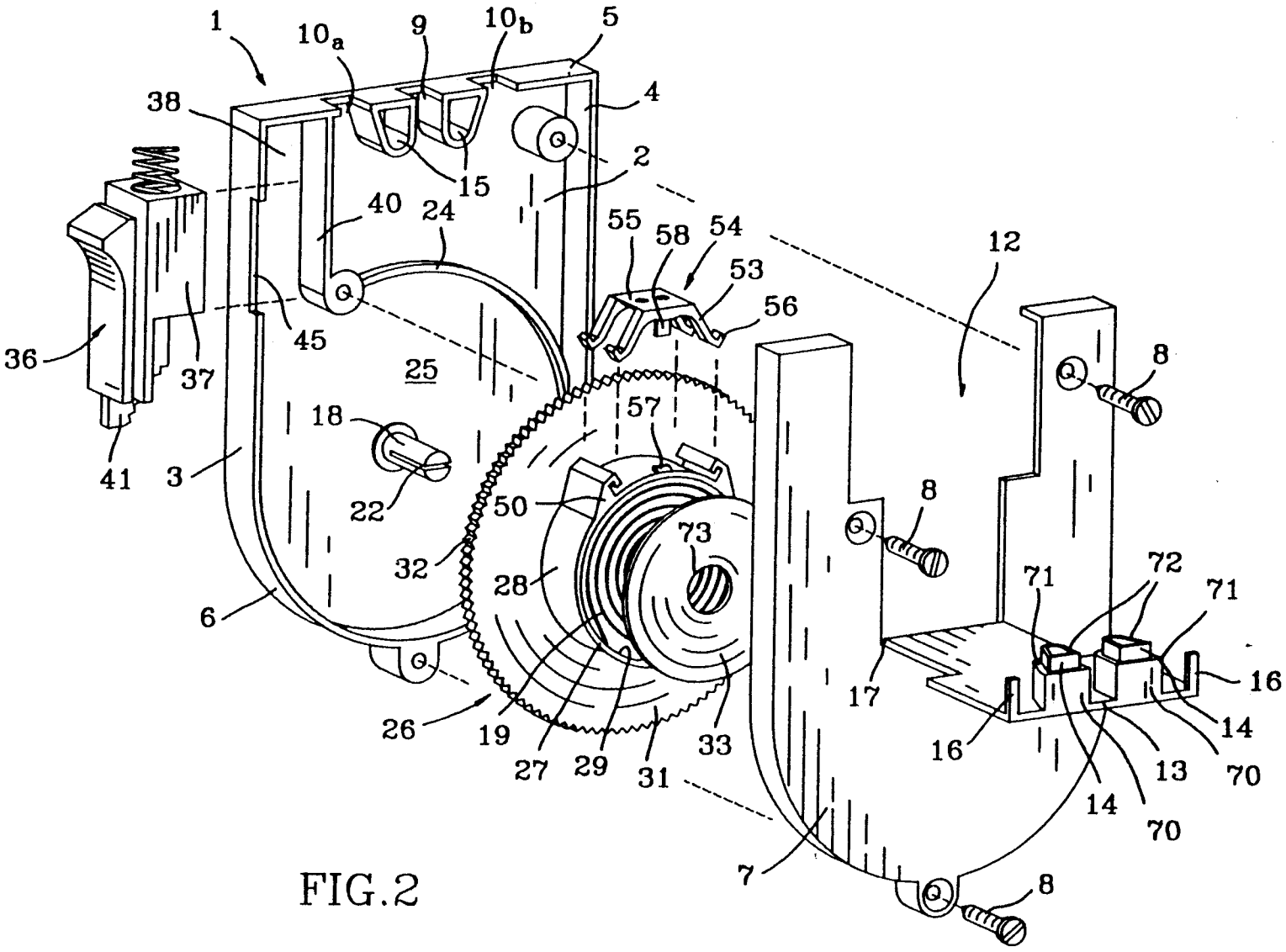
FIG. 2 is an exploded view of the device, in perspective.

Referring to FIGS. 1 and 2, the retraction device according to the present invention is provided with a rigid moulded plastic case 1, comprised of a rear wall 2, first and second side walls 3 and 4, respectively, a top 5, a convexly-curved lower wall 6 merging with said side walls, and a removable front cover 7. The cover 7 is fastened to the case by way of three screws 8. A central aperture 9 and first and second peripheral apertures 10(a) and (b), respectively, positioned on either side thereof extend through the top 5.

Figure 9:
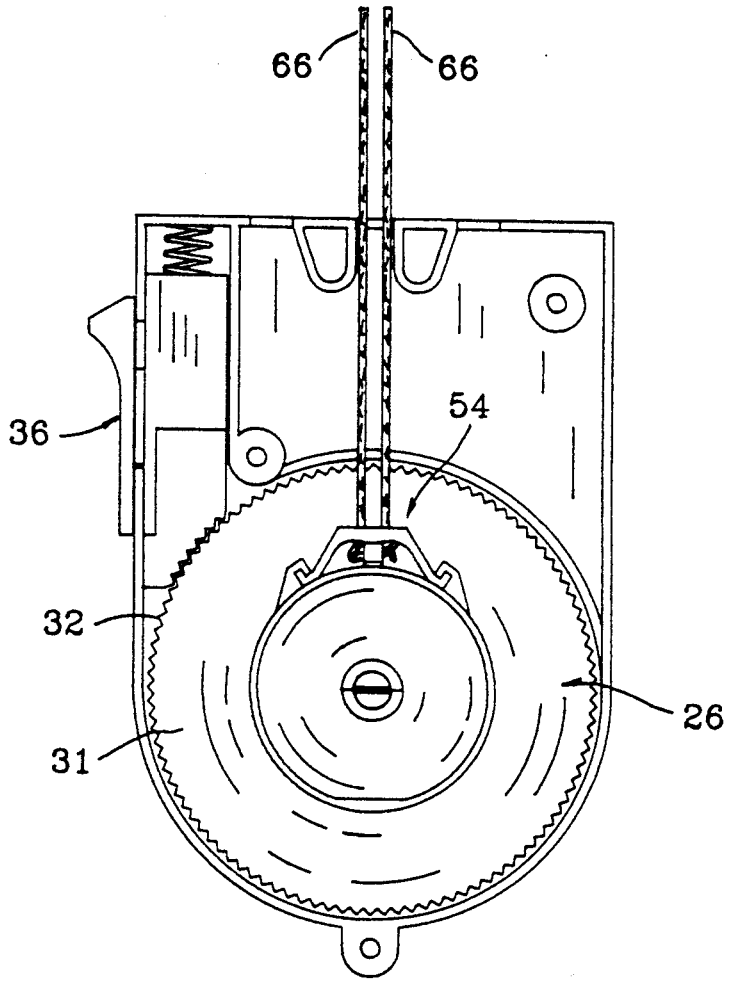
FIG. 9 is a view as in FIG. 7, showing the device in use with a pair of free-ended cords.

The device may be engaged to either a looped cord or one or more free-ended cords; in FIG. 1, the device is shown engaged to a cord loop 11, such as is typically employed in a vertical blind. The cord loop enters the case through the first peripheral aperture 10(*a*) and exits from the case through the second peripheral aperture 10(*b*). The device may also be used with a pair of free-ended cords 66 such as are typically employed in venetian blinds, as shown in FIG. 9; for this purpose, both cords enter the case through the central aperture 9.

The cover 7 has an access opening 12, to allow the user access to the interior of the case, in order to engage the device to a cord. The opening 12 consists of a large central slot extending from the upper edge of the cover to slightly below the midpoint thereof. A hinged plate 13 covers the opening 12, and may be opened to allow access into the case. The plate 13 is snap-fitted shut by means of a pair of laterally-extending closure members 14 positioned adjacent the upper edge of the plate 13, both of which face towards the interior of the case 1 when the plate is closed. Each closure member 14 comprises a base 70 and a head 72. The base 70 extends upwardly from to the interior surface of the plate 13, and terminates at its upper end in a shelf 71. The head 72, smaller in cross section than the base, extends upwardly from the shelf 71. When the plate 13 is snap-fitted shut, the shelf 71 abuts the edge of a corresponding open-ended channel member 15 extending into the interior of the case from the rear wall 2 thereof and integrally moulded therewith. The head 72 is frictionally engaged within the interior of the channel member 15. The plate 13 is also provided with a pair of extensions 16 at its upper corners, that provide cord guide means when the plate is closed.

The plate 13 and the closure members 14 are integrally moulded with the cover 7. The plate 13 has a flexible thinned portion 17 at its lower edge that serves to hinge it to the cover 7.

A curved spool retainer wall 24, integrally formed with the case 1, extends from the rear wall 2 into the interior of the case. The spool retainer wall 24 cooperates with the lower wall 6 of the case to form a generally cylindrical spool housing 25. A spindle 18, integrally moulded with the case 1, extends laterally into the interior of the case from the rear wall 2 at the center of the spool housing 25, across the interior of the case 1. A spool 26 is rotatably mounted to the spindle 18 within the spool housing 25.

Figure 3:
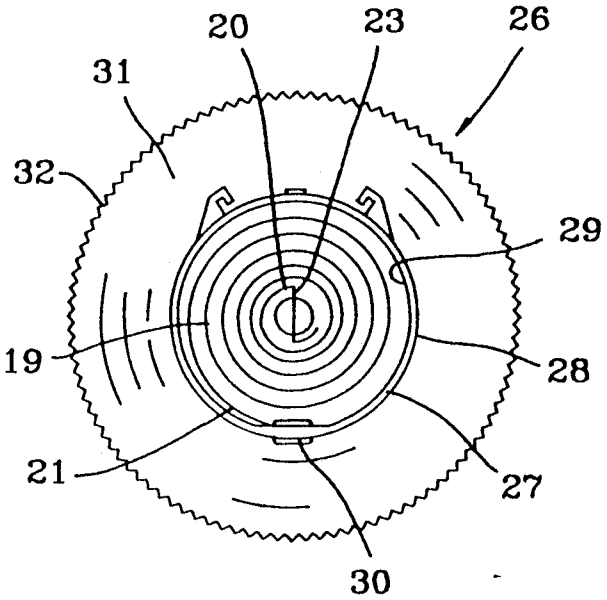
FIG. 3 is a front elevational view of the spool portion of the device.

Referring to FIGS. 2 and 3, the spool 26 comprises a hollow cylindrical spool body 27 having an exterior cord-receiving surface 28 and an interior spring-receiving surface 29. A flat coil spring 19, having interior and exterior ends 20 and 21 respectively, is positioned within the interior of the spool body 27. The spring 19 is engaged to a slot 22 (shown in FIG. 2) recessed into the free end of the spindle 18. The spring's interior end 20 has a crimped portion 23 that slides into the slot 22, the crimp preventing the spring from slipping out of the slot. A rivet 30 attaches the exterior end 21 of the spring 19 to the interior spring-receiving surface 29 of the spool. The spring 19 may be wound up by rotating the spool 26 in a counterclockwise direction, when viewed from the front. Upon release of the spool, the spring rotatably drives the spool in a clockwise direction.

The spool body 27 is provided with a flange 31 at one end thereof. The flange has a toothed rim 32, and is positioned within the spool housing 25. A cap 33 (shown in FIG. 2) is press-fitted into the opposing end of the spool body. The spindle extends through a central aperture 73 and is freely rotatable therein. The cap 33 serves to cover the spring 19 and prevent it from slipping off the spindle 18, and also provides a support for the spindle.

Figure 4:
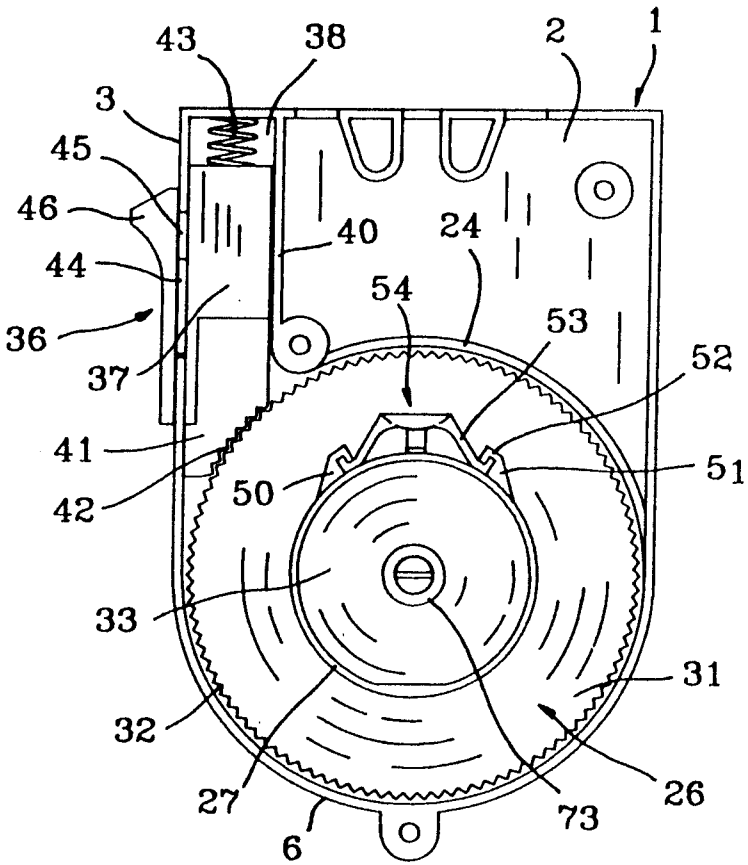
FIG. 4 is a front elevational view of the device, with the front cover removed.

Referring to FIGS. 2 and 4, the flange 31 acts in cooperation with a spring-loaded catch 36 slidingly engaged to the case 1, to releasably lock the spool 26 and prevent the free rotation thereof. The catch 36 is provided with a housing 37 positioned within a channel 38, the sides of the channel being comprised of the first side wall 3 of the case 1 and a vertically-oriented wall 40 extending into the interior of the case from the rear wall 2 of the case. The wall 40 merges at its lower end with the spool retainer wall 24. An engagement member 41 depends downwardly from the housing 37. The engagement member has a toothed lower edge 42 with a concave curvature matching the curvature of the rim 32 of the flange 31, the toothed lower edge 42 being adapted to engage the rim 32. The catch 36 is biased downwardly by a spring 43 positioned partly within and extending upwardly from the housing 37. The upper end of the spring abuts the top 5 of the case. When the catch is in the normal, downwardly-biased position, the gear engagement member engages the rim 32 of the flange 31 and prevents the spool 26 from rotating. A square neck 44 extends outwardly from the housing and extends through an aperture 45 within the first side wall 3 of the case 1. The neck 44 is engaged to a finger-operable lever 46 positioned outside the case, adapted to allow the user to push the catch upwardly, to release the spool from engagement with the catch.

The spool 26 is provided with two attachment members 50 extending radially outward from the spool body 27, positioned about 60 degrees apart from each other on the spool body. Each attachment member 50 comprises a base 51 attached to the spool body and a terminating at its upper end in a downwardly-facing hook 52. The hook 52 is adapted to releasably engage a leg 53 of a cord rotator 54.

Figure 5:
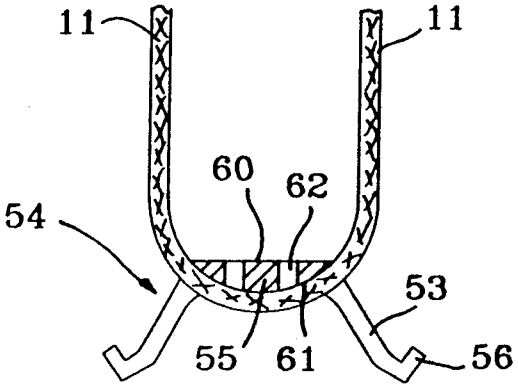
FIG. 5 is a sectional view of a cord rotator with a cord loop engaged thereto.

Referring to FIGS. 2 and 5, the cord rotator 54 is adapted to be positioned such that its longitudinal axis is circumferential with the spool body 27. The cord rotator is comprised of a generally rectangular body 55 and four legs 53 extending downwardly and longitudinally outwardly from each of the four corners of the body. The free end of each leg 53 terminates in an upwardly-angled foot 56, adapted to slidingly engage the hook 52 of a corresponding attachment member 50. A tab 58 depends downwardly from the body 55 and is adapted to mate with a ledge 57 recessed within the spool body 27 to further engage the cord rotator with the spool 26.

Figure 6:
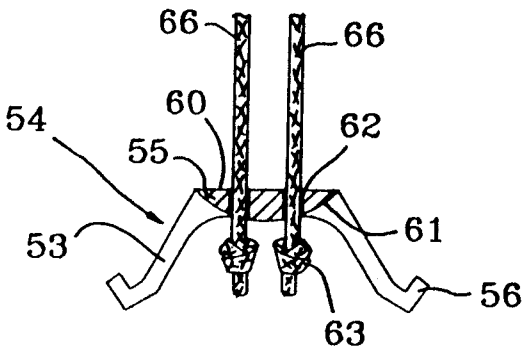
FIG. 6 is a sectional view of a cord rotator with a pair of free-ended cords engaged thereto.

The body 55 has a rectangular flat upper surface 60 and a belly 61 having the shape generally of an inverted saddle. The belly 61 is adapted to slidingly engage a cord loop 11 longitudinally therewith, as illustrated in figure 5 or, alternatively, to fixedly engage the knotted free ends of a pair of free-ended cords 66, as illustrated in FIG. 6. Two apertures 62 extend through the body 55 within which the cords 66 may be threaded. A knot 63 is tied at the end of each cord 66 to retain the cord within the aperture. The knot 63 is held in place abutting the belly 61 by tension on the cords 66 imposed by the weight of the device dangling from the cords.

Alternatively, the free-ended cords may be engaged to the cord rotator by way of tying the ends of the cords together and positioning the knot under the belly 61.

Figure 8:
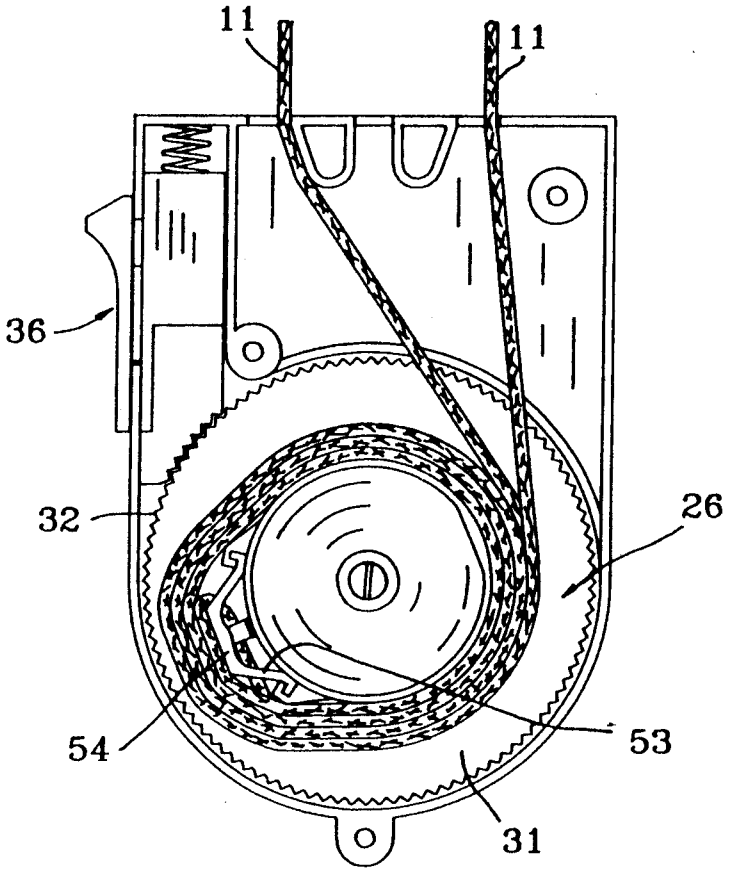
FIG. 8 is a view as in FIG. 7, showing the device with cord wound up thereon.
Figure 7:
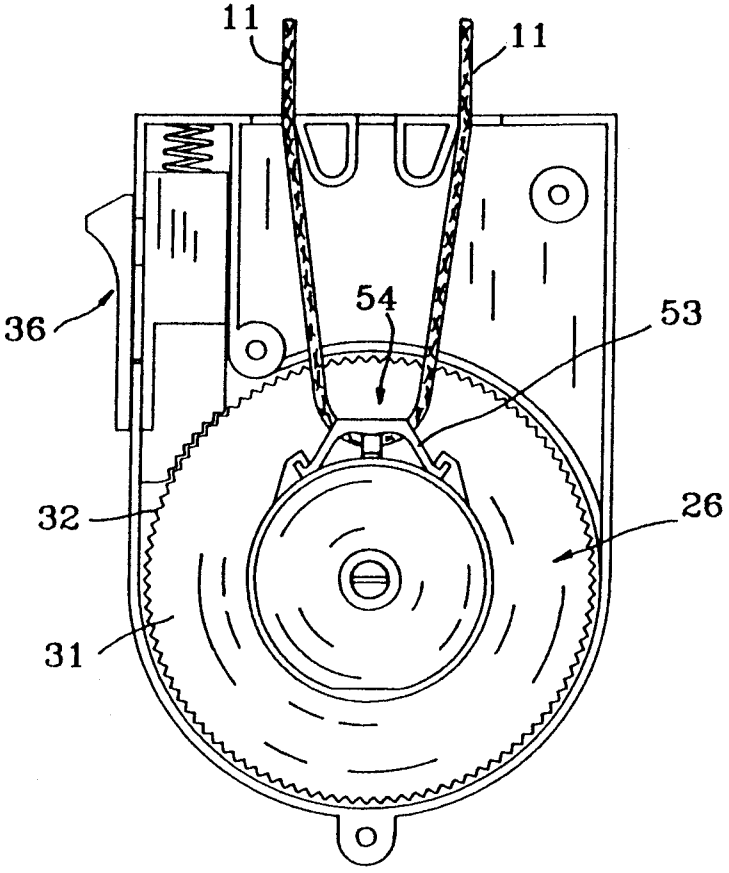
FIG. 7 is front elevational view as in FIG. 4, showing the device in use with a cord loop, with the front cover removed.

Referring to FIG. 7, the device may be fastened to a cord loop 11 of a vertical window blind set. Prior to engaging the device to a cord loop, the coil spring 19 should be in the fully wound position and the catch 36 engaged to the rim 32 of the flange 31, to prevent the spool 26 from rotating. In order to fasten the device to a cord loop, the plate 13 (shown in FIGS. 1 and 2) is opened and the cord rotator 54 removed. The cord is then positioned longitudinally under the belly 61 of the cord rotator 54, between the legs 53 lying on either side of the body 55. The cord rotator is then re-engaged onto the spool 26 with the cord thus engaged. In the position indicated in FIG. 7, with the spool in the unwound position, and the spool held in position by the catch 36, the cord loop is free to slide through the device and the user can freely pull the cord to rotate the window blind vanes or open or close the blind. Upon pushing the catch 36 upwards, the spring unwinds and rotates the spool, winding up the cord loop 11 onto the cord-receiving surface 28 of the spool body 27, as shown in FIG. 8. The catch 36 is then released to fixedly engage the spool 26 in position. When fully wound onto the spool body 27, the cord loop 11 is shortened sufficiently to keep it out of reach of young children.

The procedure may be reversed to unwind the cord loop from the spool: the catch 36 is released and the cord 11 is manually pulled from out of the device. As the cord is unwound from the spool, the spool 26 is rotated counterclockwise, winding up the spring 19.

Referring to FIG. 9, the device may be used in a similar manner with a pair of free-ended cords 66 of a venetian blind. Prior to engagement of the device with a pair of free-ended cords, the spool should again be engaged by the catch 36, with the coil spring 19 in the fully wound position. To attach a pair of cords 66 to the device, the free ends of the cords are either threaded through the apertures 62 within the cord rotator 54, and the end of each cord knotted to prevent the cord from slipping back through the aperture, or simply tied together and positioned under the belly 61. The cord rotator is then reinserted onto the spool. The device is employed in the same manner as with a cord loop to take up and release slack in the free-ended cords 66. In contrast with a vertical blind, a venetian blind may be operated with the cords partly or fully retracted by the device.

In an alternative embodiment of the device, not illustrated, the end of each free-ended cord is engaged separately to cord adjustment means on the cord rotator, in order to provide means for adjusting the position of each cord relative to the other. This additional feature allows a user to correct small unevenness in the length of the cords relative to each other, that may cause a venetian blind to be slightly skewed.

Cord adjustment means may be provided by a number of means, the simplest being a wedge insertable into the lower end of each aperture 62, adapted to fixedly engage a free-ended cord 66 inserted through the aperture. With this arrangement, each cord may be adjusted by simply pulling out the wedge, sliding the cord through the aperture by the appropriate amount, and reinserting the wedge.

Although the present invention has been described in detail by way of preferred embodiments thereof, it will be understood by those skilled in the art that variations may be made thereto without departing from the spirit and scope of the invention, as defined by the appended claims.

I claim:

1. A cord retraction device for window coverings, comprising a spool having a cord-receiving surface, drive means to rotate said spool, and cord guide means to direct a cord towards the cord receiving surface of the spool to be wound thereon, said spool having a cord loop attachment member that engages to said spool a cord loop formed by said cord, said attachment member being fixedly linked to and extending from said cord receiving surface and having a passage therethrough, said passage having sufficient diameter to allow said cord loop to slide freely therethrough when in an unwound position on said spool.

2. A cord retraction device as claimed in claim 1 wherein said member extends outwardly from said cord-receiving surface.

3. A cord retraction device as claimed in claim 2 wherein said member is releasably engaged to said spool.

4. A cord retraction device as claimed in claim 3 wherein said member is comprised of a body and four legs depending downwardly therefrom, each of said legs having a foot at the free end thereof releasably engageable to said spool, said body adapted to slidingly engage said cord loop between said legs.

5. A cord retraction device as claimed in claim 1 having a housing, with the spool and drive means disposed within said housing.

6. A cord retraction device as claimed in claim 5 wherein said housing is provided with an aperture to allow user access to said attachment means.

7. A cord retraction device as claimed in claim 1 wherein said drive means comprise a coil spring positioned within the interior of the spool, engaged at one end thereof to a fixed shaft axial to said spool and to the spool at the other end thereof.

8. A cord retraction device as claimed in claim 1 wherein there is further provided a catch to releasably engage said spool and prevent the rotation thereof relative to the cord guide means.

* * * * *